United States Patent [19]

Kavoussi et al.

[11] Patent Number: 4,573,804

[45] Date of Patent: Mar. 4, 1986

[54] SCENT-AWAKE ELECTRONIC CLOCK

[76] Inventors: James P. Kavoussi, 1401 - 80th St., Brooklyn, N.Y. 11228; Louise D. Hartford, 391 Durant Ave., Staten Island, N.Y. 10308

[21] Appl. No.: 720,530

[22] Filed: Apr. 8, 1985

[51] Int. Cl.[4] ..... G04B 47/00

[52] U.S. Cl. ..... 368/12; 368/250

[58] Field of Search ..... 368/10, 12, 72–74, 368/250; 222/70, 645–648

[56] References Cited

U.S. PATENT DOCUMENTS 3,455,102 7/1969 Wolf ..... 368/73

4,407,585 10/1983 Hartford et al. ..... 368/12

*Primary Examiner*—Vit W. Miska

*Attorney, Agent, or Firm*—Richard L. Miller

[57] ABSTRACT

A scent-awake electronic clock is provided which wakes the user with a scent followed by a snooze period after which an external alarm, such as a bell or a flashing light are activated. A timer circuit determines the duration of both the scent and the external alarms. A variable counter circuit allows the user to determine the time interval between the initiation of the initial scent alarm and the beginning of the snooze period after which the external alarm sounds. A switch is provided which allows the user to have the external alarm activate during both the scent alarm time and after the end of the snooze time.

2 Claims, 2 Drawing Figures

SCENT-AWAKE ELECTRONIC CLOCK

BACKGROUND OF THE INVENTION

The present invention relates generally to the field of alarm clocks, and, more specifically, to an alarm clock which awaken the user with a scent, and, later, a noise.

It is well-known that conventional alarm clocks awaken a sleeper by a buzzer and, in some instances, by a flashing light either used in conjunction with the buzzer or separately. However, a buzzer system can often startle the sleeper and cannot be heard by a hearing impaired user. Further, the flashing light may even be ineffective to a sleeper if he or she is blind or even if he or she is turned away from the light source so that the flashing light does not reach the eyes of the sleeper.

It has also been well established the the manner of awakening effects the disposition of the person awaken, so that a gentle nudge or the scent of pine needles is more likely to improve the disposition of the user, than say the use of a loud jarring bell. A better approach would be to attempt to awake the user with a fragrance, and then, if that is not successful, to attempt to waken the user with a noise or a light.

L. Hartford et. al., U.S. Pat. No. 4,407,585, provides a variety of techniques for releasing a fragrance at some predetermined time, however, no provision is made to awaken the user if the scent is not successful.

SUMMARY OF THE INVENTION

It is, therefore, a primary object of the present invention to provide a scent-awake alarm clock which first attempts to awaken the user with a scent and, if not successful, awakens the user with an external alarm such as a bell or a flashing light.

A further object is to provide a scent-awake alarm clock which emits a scent or a sound for a pre-determined time period.

A still further object is to provide a scent-awake alarm clock which allows the user to vary the time interval between the beginning of the first, or scent alarm period and the beginning of the snooze interval, after which the external alarm is initiated.

A yet still further object is to provide a scent-awake alarm clock in which the external alarm can be initiated only during the second, or snooze alarm period, or, by using a simple switch, be made to operate during both alarm periods.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
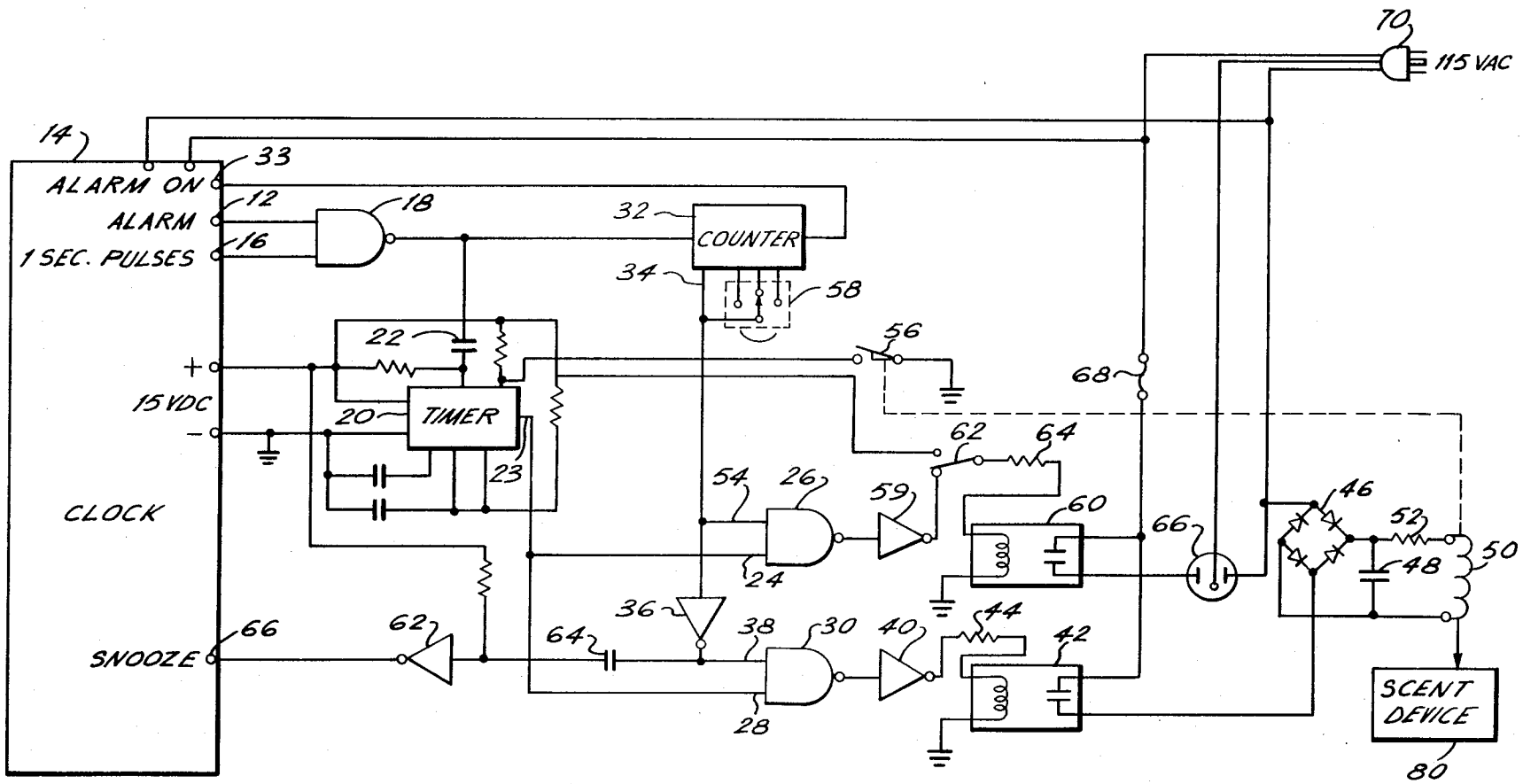
FIG. 1 is an electronic schematic diagram of the invention.

The operation of the invention is initiated when closure takes place on alarm output 12 when the time on clock 14 has reached a pre-determined hour. Meanwhile, clock pulses, at one second intervals are outputted at 16. The output of NAND gate 18 is a series of clock pulses when alarm output 12 is activated.

The first clock pulse initiates timer 20, via capacitor 22. The output of timer 20, at 22 goes high as does input 24 of NAND gate 26 and input 28 of NAND gate 30. Meanwhile, since counter 32, which was turned on by the closure of alarm contact 33, has not yet reached its maximum count, its output at 34 is low, and this low is inverted to a high by inverter 36. This high is inputted to input 38 of NAND gate 30. Since both inputs 28 and 38 are both high, the output of NAND gate 30 is low; but it is inverted by inverter 40 which activates solid state relay 42 via resistor 44. When relay 42 is activated, ac is applied to diode bridge 46, whose dc output is filtered by capacitor 48 and activates solenoid 50 via resistor 52. Solenoid 50 operates a scent releasing mechanism 80 and continues to do so for the duration of the on-interval of timer 20. Timer 20 may be any timer chip, such as the ubiquitous 555 chip. During this time, NAND gate 26 has been kept off since input 54 is in a low state.

When timer 20 has reached the end of its timer interval the output at 23 goes low. This places input 28 of NAND gate 30 in a low state which turns solid state relay 42 off, disabling solenoid 50 and the scent halts. When solenoid 50 is de-energized, limit switch contacts 56, which are operated by solenoid 50, close, resetting timer 20. Meanwhile, counter 32 has been counting pulses and when the number of pulses, determined by rotary switch 58, has been reached, the output of counter 32, at 34 goes high driving input 54 of NAND gate 26 high and, via inverter 36 drives input 38 of NAND gate 30 low. Simultaneously, the change in state at input 38 is transmitted via capacitor 64 and inverter 62 to snooze input 66. This input turns alarm output 12 off for a fixed time, typically nine minutes, which allows the user to get additional sleep. The setting of rotary switch 58, therefore determines when the snooze time will begin although the length of snooze time is determined by clock 14 itself. After typically nine minutes, alarm output 12 is again activated which re-initiates timer 20 driving output 23 high and driving input 54 of NAND gate 26 high as well. Since both inputs of NAND gate 26 are high the output is low; but the output is inverted by inverter 59. The output of inverter 59 activates solid state relay 60, via toggle switch 62 and resistor 64. This activation of relay 60 provides power to outlet 66 to power an external alarm. NAND gate 30 is kept off since input 38 is low, therefore, the scent alarm is turned off as well. Counter 32 may be any decade counter such as the ubiquitous TTL 4017B chip. The clock 14 referred to may be any appropriate clock such as the Micronta, Inc. model 63-753. When timer 20 completes its timing interval output 23 goes low, turning off relay 60 and disabling any external alarm output socket 66. The entire cycle is now reset and the process may begin at the next alarm time.

Figure 2:
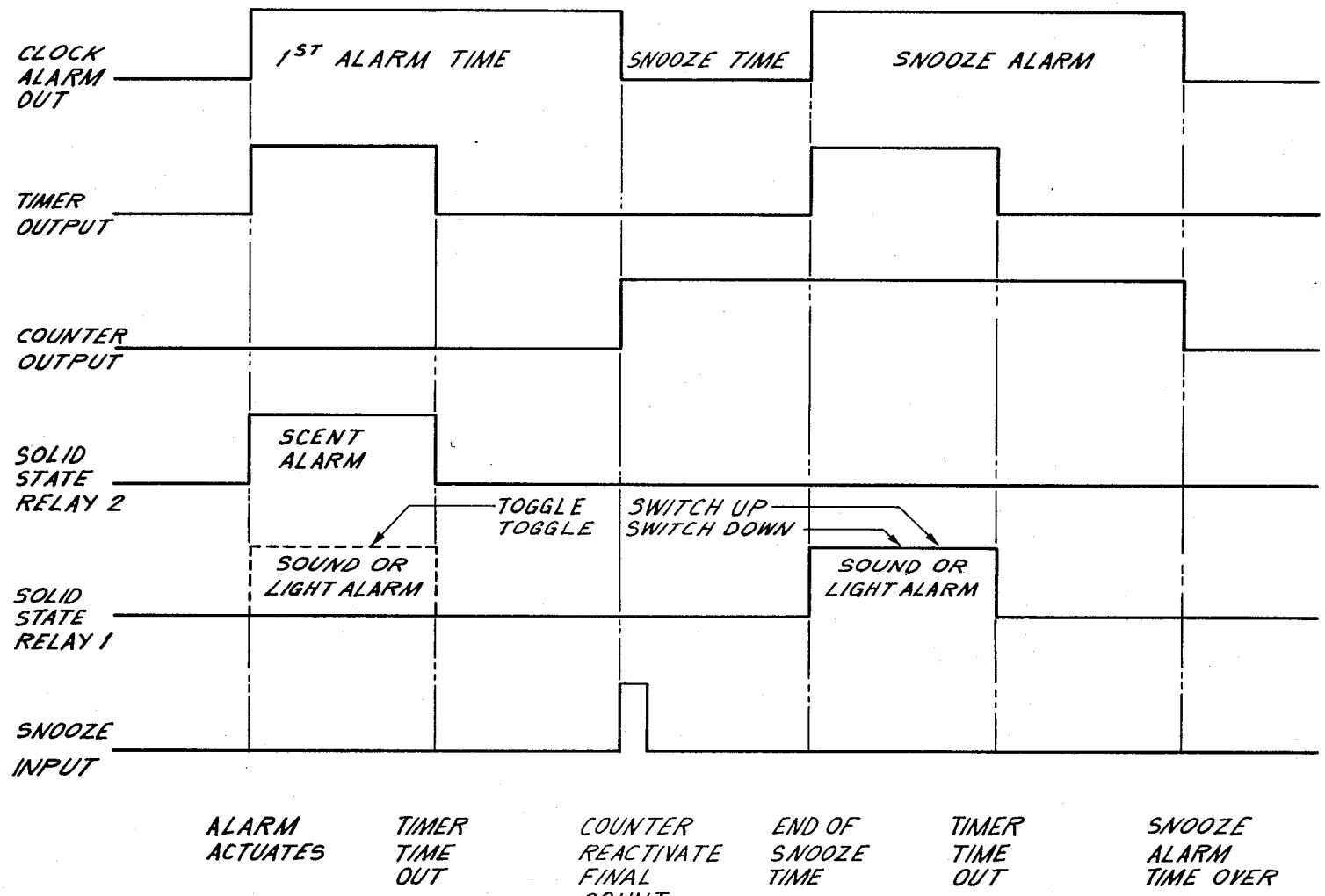
FIG. 2 is a timing diagram which describes the operation of the invention.

If the user wishes to have both the scent alarm and the external alarm operate during the first, or scent alarm period, and the external alarm operate alone during the second, or snooze alarm period, then toggle switch 62 is changed to the upper switch contact position. This permits the operation of relay 60 whenever timer 20 is operating. This optional mode is shown in dashed lines in FIG. 2.

The external alarm socket 66 as well as diode bridge 46 and its associated circuitry are protected by fuse 68 which is in series with power entering via ac plug 70.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A scent-awake electronic clock, comprising in combination:

(a) an electronic clock having an alarm contact closure which is activated at a predetermined time, output clock pulses which occur at one second intervals, and a snooze input which, when triggered, deactivates said closure and reactivates said closure after a fixed period of time thereby permitting a snooze interval followed by another alarm contact closure;

(b) a first NAND gate;

(c) a second NAND gate;

(d) a third NAND gate;

(e) a timer circuit which is initiated when said alarm contact closure and said clock pulses are inputted to said first NAND gate; wherein said timer circuit output is inputted to said second NAND gate and said third NAND gate; wherein said timer circuit is reset at the end of every alarm period; whereby the duration of both a scent alarm and an external alarm are determined by said timer circuit's interval;

(f) a counter whose output is initiated when a predetermined number of said clock pulses has occurred, wherein said output is inputted to said second NAND gate and wherein said output is inverted and then inputted to said third NAND gate; whereby the interval of time between the initiation of a scent alarm and the initiation of a snooze time period may be selected by varying the modulus of said counter;

(g) said second NAND gate the output of which is inverted and inputted to a first relay;

(h) said first relay the output of which activates an external alarm;

(i) said third NAND gate the output of which is inverted and inputted to a second relay;

(j) said second relay the output of which activates a scent alarm;

(k) an inverter, with a series capacitor at its input which takes said inverted pulse from one input of said third NAND gate and couples a pulse to said snooze input when said counter is finished counting, thereby initiating said snooze period;

(l) said scent alarm which releases a scent during a first alarm period, and (m) an external alarm socket which is activated after said snooze interval during a snooze alarm period.

2. A scent awake electronic clock, as recited in claim 1, further comprising a switch connected to said first relay whereby when said switch is in a first position said first relay is connected to said output of said second NAND gate, thereby operating said external alarm only during said snooze alarm period; and, whereby when said switch is in a second position, said relay is connected directly to said timer such that said external alarm is activated during both said first alarm period and said snooze alarm period.

* * * * *